US008888457B2

(12) United States Patent
Luo

(10) Patent No.: US 8,888,457 B2
(45) Date of Patent: Nov. 18, 2014

(54) DUAL-ROTOR MODEL HELICOPTER CONTROL SYSTEM

(76) Inventor: Zhihong Luo, Guangzhou (CN)

( * ) Notice: Subject to any disclaimer, the term of this patent is extended or adjusted under 35 U.S.C. 154(b) by 1043 days.

(21) Appl. No.: 12/886,582

(22) Filed: Sep. 21, 2010

(65) Prior Publication Data

US 2011/0158809 A1 Jun. 30, 2011

(30) Foreign Application Priority Data

Dec. 31, 2009 (CN) ..... 2009 1 0215989

(51) Int. Cl.
*B64C 27/54* (2006.01)
*B64C 27/10* (2006.01)
*A63H 27/00* (2006.01)

(52) U.S. Cl.
CPC ..... *A63H 27/12* (2013.01)
USPC ..... 416/124; 416/144; 244/17.23

(58) Field of Classification Search
USPC ..... 416/144, 145, 120, 124, 128
See application file for complete search history.

(56) References Cited

U.S. PATENT DOCUMENTS 7,946,526 B2 * 5/2011 Zimet ..... 244/17.19
8,186,615 B2 * 5/2012 Uebori et al. ..... 244/17.25
2004/0184915 A1 * 9/2004 Kunii et al. ..... 416/114
2006/0102777 A1 * 5/2006 Rock ..... 244/17.25
2007/0105475 A1 * 5/2007 Gotou et al. ..... 446/37

FOREIGN PATENT DOCUMENTS

CN 1496923 A 5/2004
WO 02/064425 A2 8/2002

OTHER PUBLICATIONS

Hirobo Instruction Manual for SDX SWM helicopter, copyright 2009, No. 10C88.*

* cited by examiner

*Primary Examiner* — Richard Edgar
*Assistant Examiner* — Ryan Ellis
(74) *Attorney, Agent, or Firm* — Muncy, Geissler, Olds & Lowe, P.C.

(57) ABSTRACT

A coaxial dual-rotor model helicopter system includes a power control mechanism, a transmission mechanism, a control mechanism and a rotor mechanism. The rotor mechanism includes an upper rotor and a lower rotor coaxially installed on an upper side and a lower side of a main shaft and controlled by an inner shaft and an outer shaft for rotating. The control mechanism includes a Bell self-balance mechanism to control the upper rotor and a Bell-Hiller control structure to control the lower rotor. The power control mechanism controls the rotor mechanism through the transmission mechanism and the control mechanism. The present invention achieves balance effect through the upper rotor by employing the Bell self-balance mechanism that has a great stability to provide automatic control. The lower rotor aims to control direction and employs the Bell-Hiller control structure that has a high maneuverability to perform active control.

8 Claims, 12 Drawing Sheets

DUAL-ROTOR MODEL HELICOPTER CONTROL SYSTEM

FIELD OF THE INVENTION

The present invention relates to a coaxial dual-rotor model helicopter and particularly to a dual-rotor model helicopter control system to provide improved stability and maneuverability.

BACKGROUND OF THE INVENTION

Conventional coaxial dual-rotor model helicopters such as those disclosed in PCT publication no. WO 02/064425 A2 and Chinese publication No. CN1496923A include two rotors installed on a shaft, one for veer control and another for balance control. Maneuverability and stability mainly depend on whether the balance mechanism adopts balance paddles (WO 02/064425 A2) or balance weights (CN1496923A). Those adopted the balance paddle mechanism have superior balance and veer control but inferior stability, while those adopted the balance weight mechanism have improved stability but poor maneuverability, which are more suitable for novices at aviation models. However, both of the aforesaid structures have a great number of elements, malfunction frequently occurs. Moreover, design for coordination of upper and lower rotors is more sophisticated, and more adjustment parameters are needed and adjustment is complicated. Thus the costs are higher and usability is lower.

As the performances of the aforesaid toy helicopters vary in extremes, either has a great stability or a great maneuverability, they are suitable only for novices or players with experience or professional skills, but not desirable for midrange players who have limited experience but not yet reached the professional level. In short, there is still a need for a midrange model helicopter both in terms of stability and maneuverability in the present market that is yet to be fulfilled.

SUMMARY OF THE INVENTION

The primary object of the present invention is to overcome the shortcomings of the conventional techniques by providing a dual-rotor model helicopter control system to offer improved stability and maneuverability.

In order to achieve the foregoing object, the dual-rotor model helicopter control system according to the present invention comprises a power control mechanism, a transmission mechanism, a control mechanism and a rotor mechanism. The rotor mechanism includes an upper rotor and a lower rotor coaxially installed on an upper side and a lower side of a main shaft and controlled respectively by an inner shaft and an outer shaft for rotating. The present invention provides an improved structure in the control mechanism that includes a Bell self-balance mechanism to control the upper rotor and a Bell-Hiller control structure to control the lower rotor. The power control mechanism controls the rotor mechanism through the transmission mechanism and the control mechanism. The present invention achieves balance effect through the upper rotor and employs the Bell self-balance mechanism that has a great stability to provide automatic control. The lower rotor aims to control direction and employs the Bell-Hiller control structure that has a high maneuverability to perform active control. In a non-active control situation, the Bell self-balance mechanism can automatically correct interferences caused by external factors such as airflow and the like to maintain desired stability. In an active control condition, such as veering, the higher maneuverable Bell-Hiller control structure provides sufficient and desired maneuverability to the helicopter.

The present invention provides mechanisms with different functions on the two rotors so that the helicopter can fly in a stable condition and also can be controlled and maneuvered flexibly. Aiming for such a goal, the Bell self-balance mechanism may also be installed on the lower rotor and the Bell-Hiller control structure installed on the upper rotor. The Bell self-balance mechanism or Bell-Hiller control structure may be installed respectively on an upper side or lower side of the rotor mechanism.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
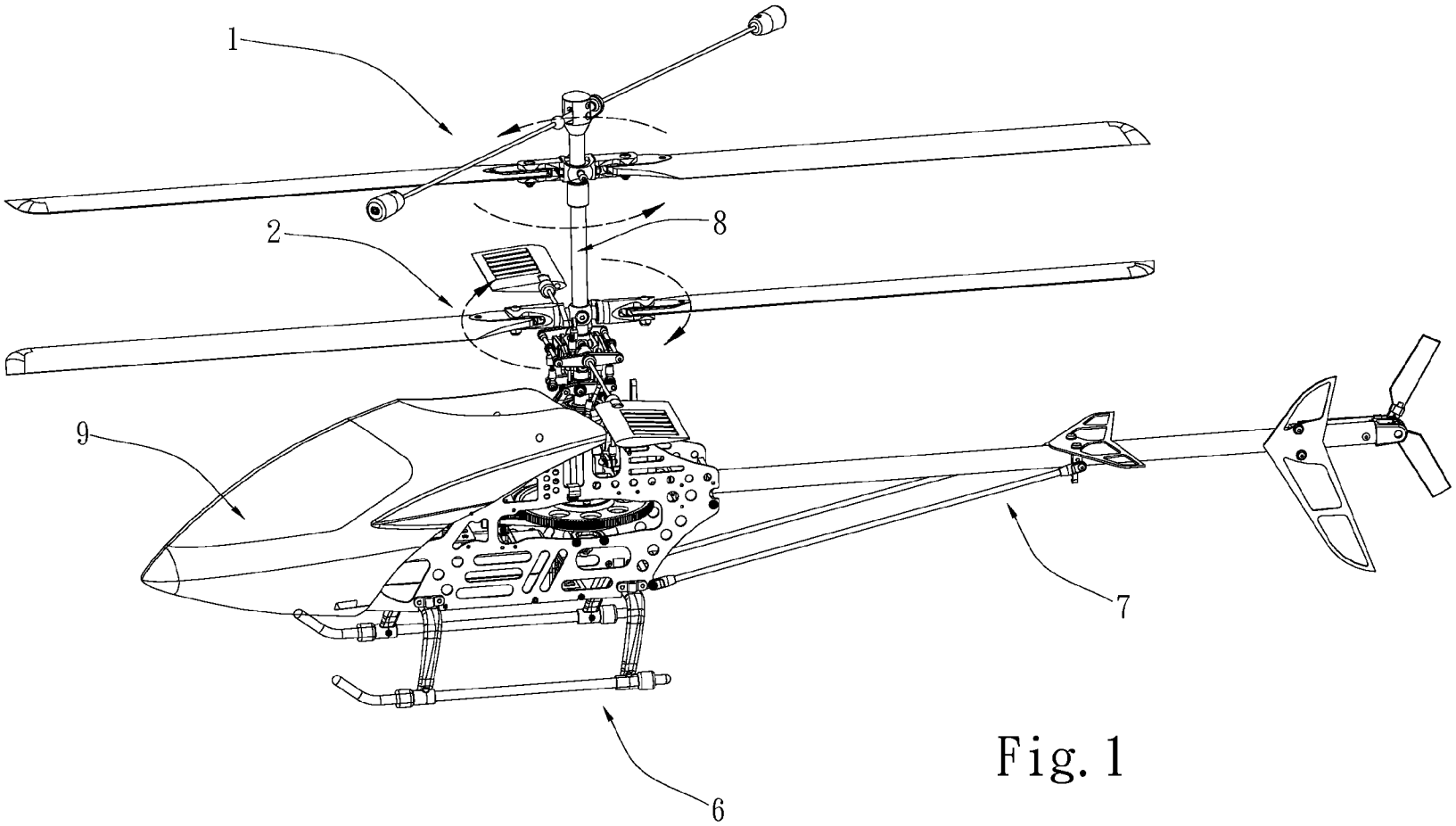
FIG. 1 is a schematic view of the structure of the present invention.
Figure 2:
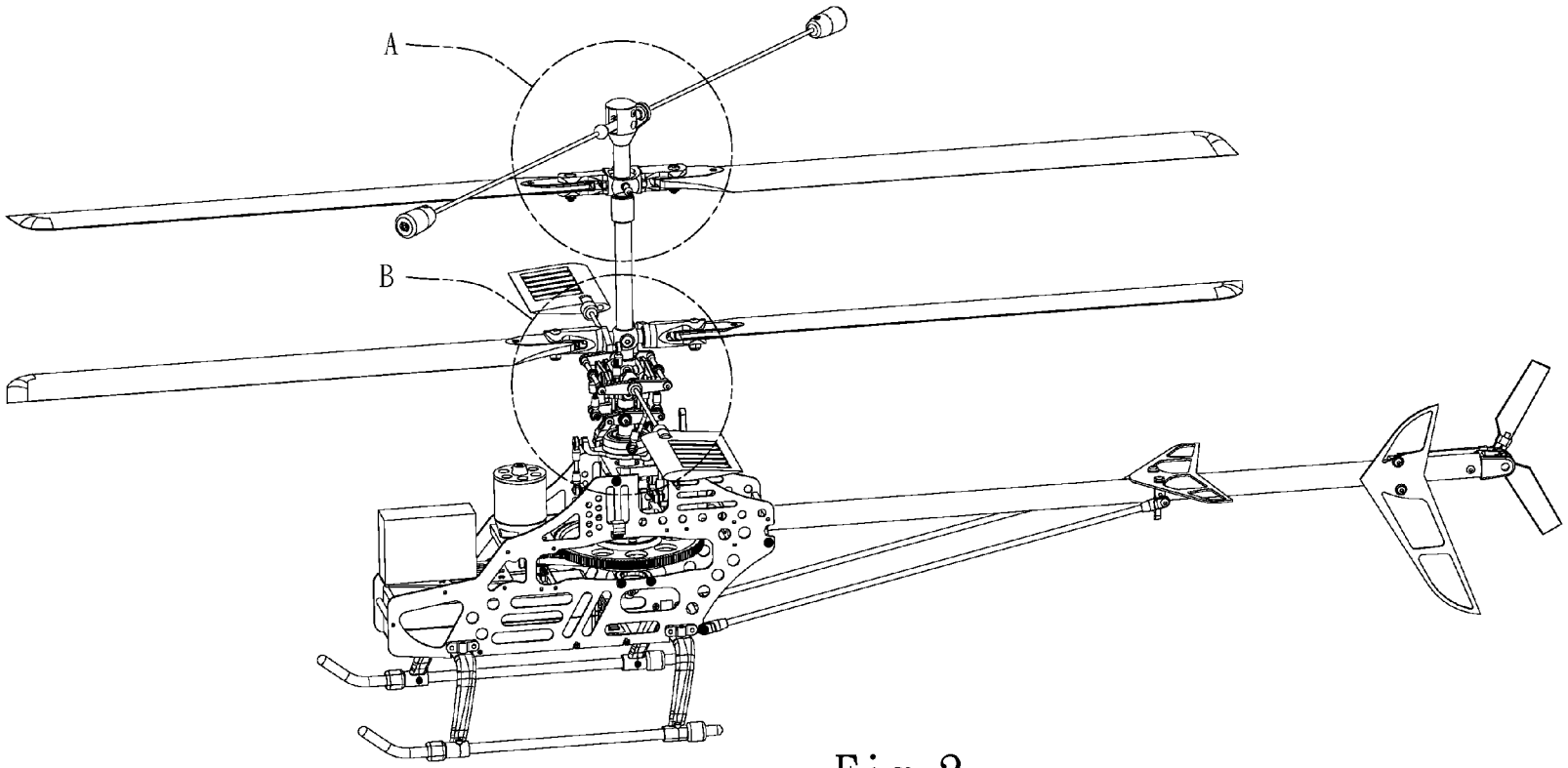
FIG. 2 is a schematic view of an internal structure according to FIG. 1.

Please refer to FIG. 1, the dual-rotor model helicopter according to the present invention includes a fuselage 6 with an ornamental casing 9 at a front end, a tail assembly 7 at a rear end and a main shaft 8 in the middle to drive a balance system 1 and a veering system 2 to rotate in opposite directions as marked by the arrows in the drawing. Also refer to FIG. 2 for the structure with the ornamental housing 9 removed and FIG. 3 for detailed elements. The entire dual-rotor model helicopter can be divided into eight portions: the balance system 1 comprising an upper rotor 12 and a Bell self-balance mechanism 11, the veering system 2 comprising a lower rotor 22, a Bell-Hiller control structure 21 and a slant rotary disk 23, a power control mechanism 3 comprising three rudder sets 31, 32 and 33 evenly disposed on a same circle and spaced from each other at an angle of 120 degrees, an aviation power mechanism 4 comprising an electric apparatus 41 and a speed changing mechanism 42, a circuit system 5 comprising a wireless transceiver circuit 51 and a battery 52, the fuselage 6 comprising a left chassis 61, a right chassis 62, a landing gear 63 and linkage structures bridging them, the tail assembly 7 comprising a tail wing shaft 71, a propeller 72, a horizontal stabilizer 73, a vertical fin 74 and bracing bars 75, and the main shaft 8 comprising an inner shaft 81 and an outer shaft 82 coupled together.

Figure 4:
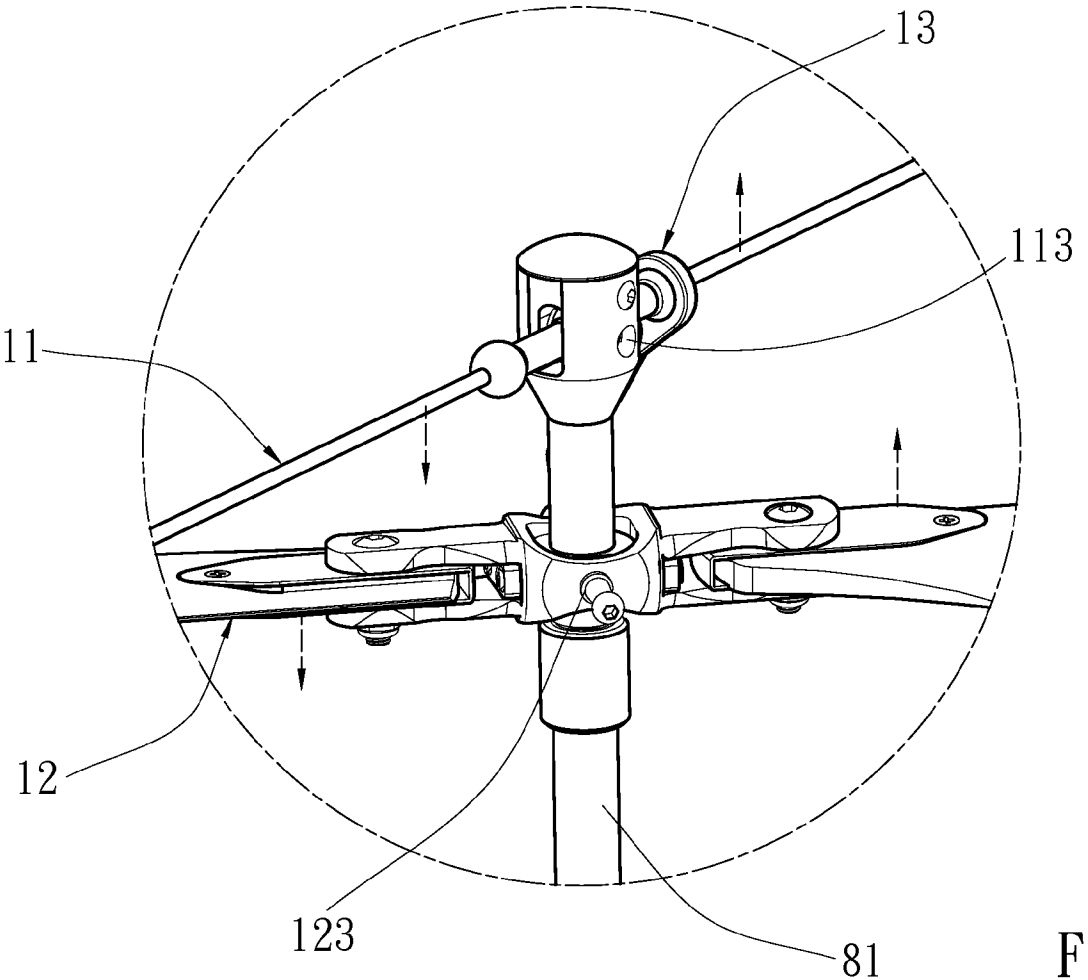
FIG. 4 is a fragmentary enlarged view of segment A in FIG. 2.
Figure 5:
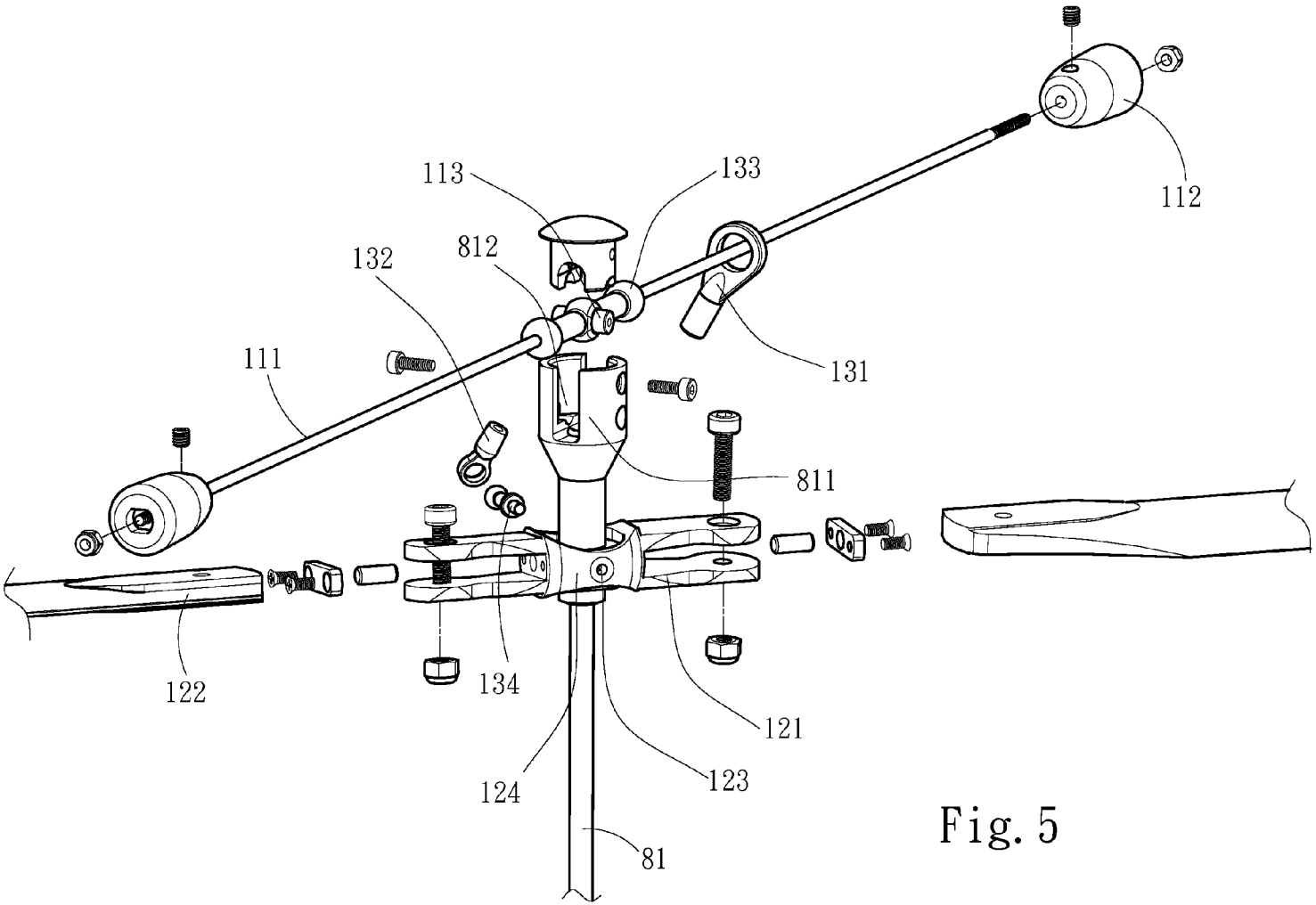
FIG. 5 is an exploded view according to FIG. 4.

Refer to FIGS. 4 and 5 for the balance system 1. The Bell self-balance mechanism 11 includes a balance bar 111 and balance weights 112 located at two ends of the balance bar 111. The upper rotor 12 includes an upper rotor clip 121 and two upper blades 122 clamped by two ends of the upper rotor clip 121. The Bell self-balance mechanism 11 and upper rotor 12 are installed on an upper portion of the inner shaft 81 through spindles 113 and 123 that are perpendicular to the main shaft 8, and are located on different planes and connected by self-balance bar 13. The spindles 113 and 123 of the Bell self-balance mechanism 11 and upper rotor 12 are parallel with each other and revolve independently in a tilted manner about their own axes as marked by the arrows in FIG. 4. The upper rotor clip 121 has a frame 124 in the middle that is coupled on the inner shaft 81 through the spindle 123 and turnable. The inner shaft 81 has a shaft holder 811 at the top end with a notch 812 formed thereon in the middle. The Bell self-balance mechanism 11 has a middle portion mounted onto the shaft holder 811 through the spindle 113 and is movable up and down in a tilted manner. The balance bar 111 is slidable in the notch 812. The self-balance bar 13 has two ball sleeves 131 and 132 at two ends that are respectively connected to two ball fasteners 133 and 134 located respectively on the Bell self-balance mechanism 11 and upper rotor 12. The Bell self-balance mechanism 11 and upper rotor 12 are bridged by the self-balance bar 13 so that they are moveable synchronously in the tilted manner during flying. In the event that the main shaft 8 is tilted against the upper rotor 12 due to external interference during flying, the Bell self-balance mechanism 11 can correct the angle between the main shaft 8 and upper rotor 12 through centrifugal principle so that both of them remain perpendicular with each other. Thereby a stable effect can be achieved. Please refer to Chinese patent No. CN1496923A for detailed operation principle, if desired.

Figure 6:
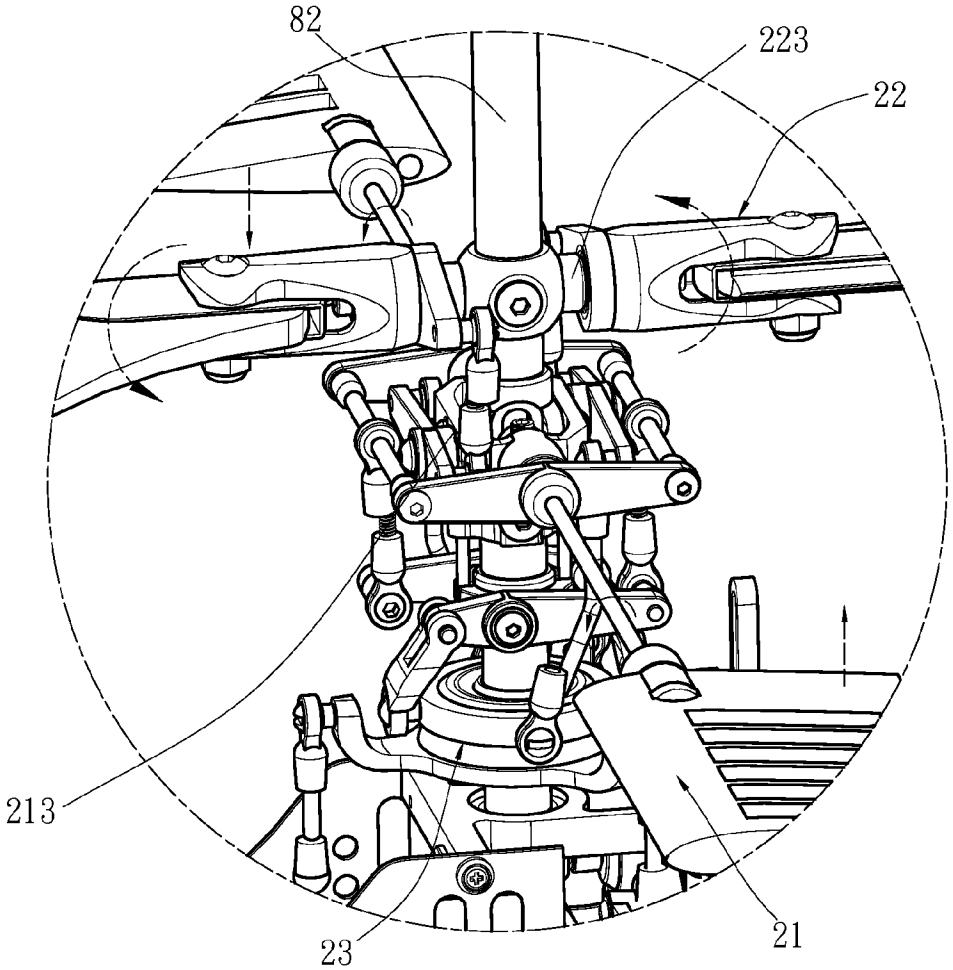
FIG. 6 is a fragmentary enlarged view of segment B in FIG. 2.
Figure 7:
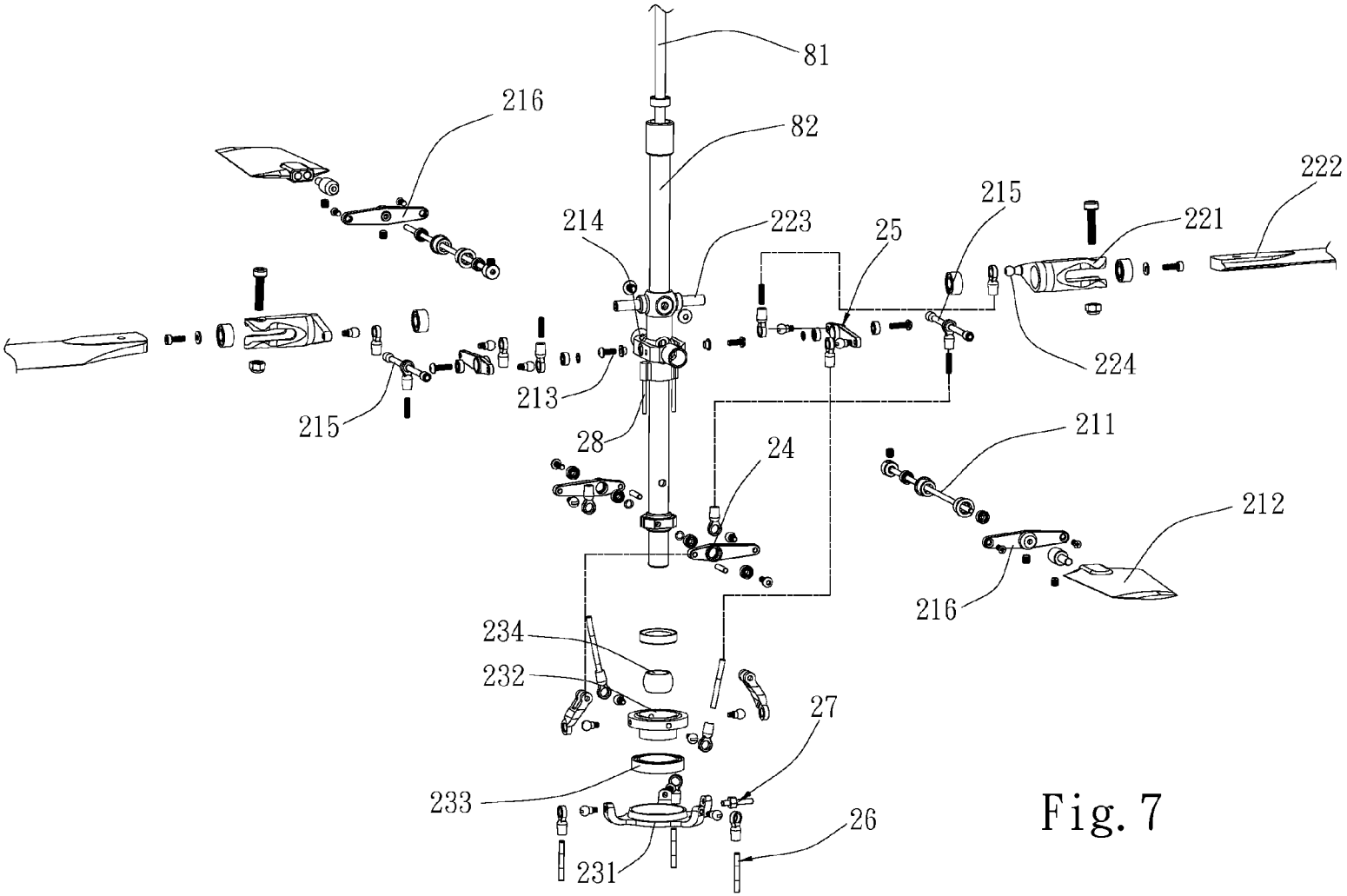
FIG. 7 is an exploded view according to FIG. 6.

Refer to FIGS. 6 and 7 for the Bell-Hiller control structure 21. It comprises a direction control bar 211 and blades 212 installed on two ends of the direction control bar 211, the lower rotor 22 and the Bell-Hiller control structure 21 that are installed on a lower portion of the outer shaft 82 through axles 223 and 213 that are perpendicular to the main shaft. They are perpendicular with each other and coupled with the power control mechanism 3 through a transmission mechanism. The axles 223 and 213 of the lower rotor 22 and the Bell-Hiller control structure 21 are parallel with and perpendicular to each other. The axle 223 coincides with the axis of the lower rotor 22. The lower rotor 22 revolves about its axis as marked by the arrows in FIG. 6. The Bell-Hiller control structure 21 can revolve about the axle 213 in a tilted manner as marked by the arrows in FIG. 6.

Figure 8:
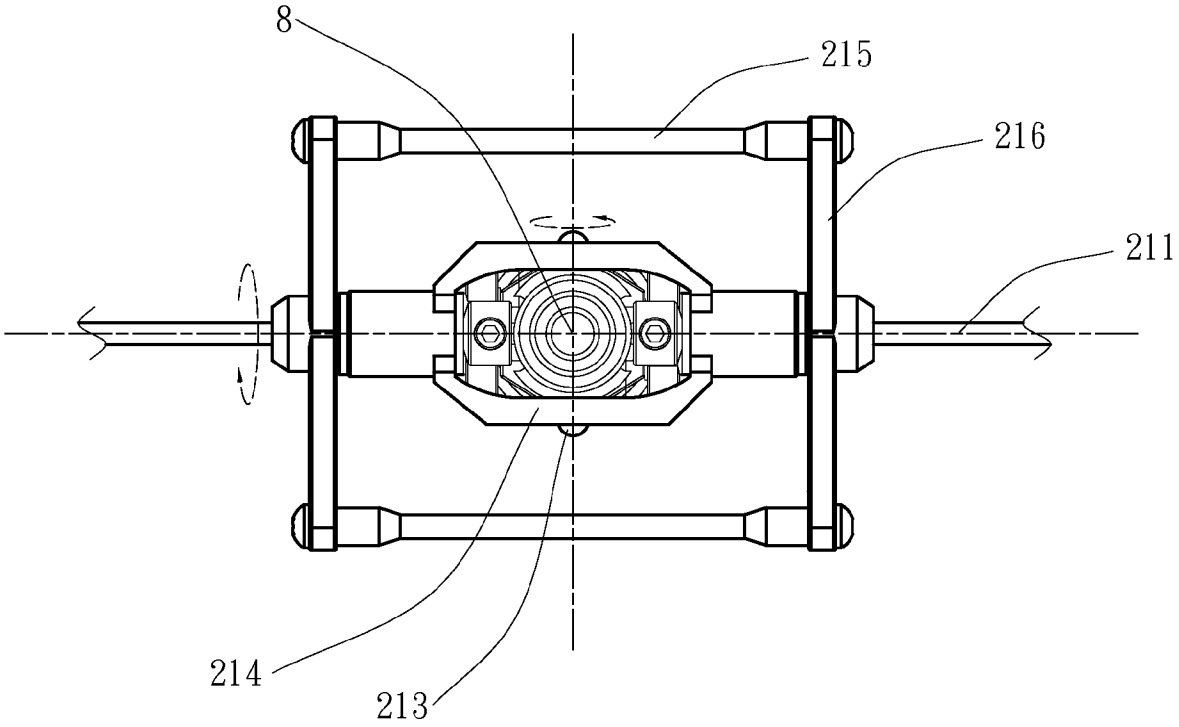
FIG. 8 is a schematic view showing vibration conditions of axle of the Bell-Hiller control structure.

The lower rotor 22 includes two lower rotor clips 221 and two lower blades 222. Each of the lower rotor clips 221 has a front end clipping the lower blade 222 and a distal end inserted into the axle 223 of the lower rotor 22. The lower rotor clip 221 has an eccentric control end 224 at one side, and an upper disk 232 of the slant rotary disk 23 coupled with the eccentric control end 224 through a linkage bar mechanism to control revolving of the lower rotor 22 about the axle 223. The direction control bar 211 of the Bell-Hiller control structure 21 has a middle portion coupled on the main shaft 8 through a frame for rotating. The frame includes an inner frame 214 and an outer frame comprising frame elements 215 and 216. The inner frame 214 rotates about the axle 213 of the Bell-Hiller control structure 21 in a vibration manner, while the outer frame rotates about the axis of the direction control bar 211 in a vibration manner. The directions that the inner and outer frames rotate are perpendicular to each other as shown in FIG. 8. The direction control bar 211 is fixed on the outer frame and inserted into the inner frame 214 is a turnable manner. The outer frame can be turned to drive the direction control bar 211 to turn. The slant rotary disk 23 is coupled with two ends of the outer frame through a linkage bar mechanism to control the angle of the blades 212 at the distal end of the direction control bar.

Figure 3:
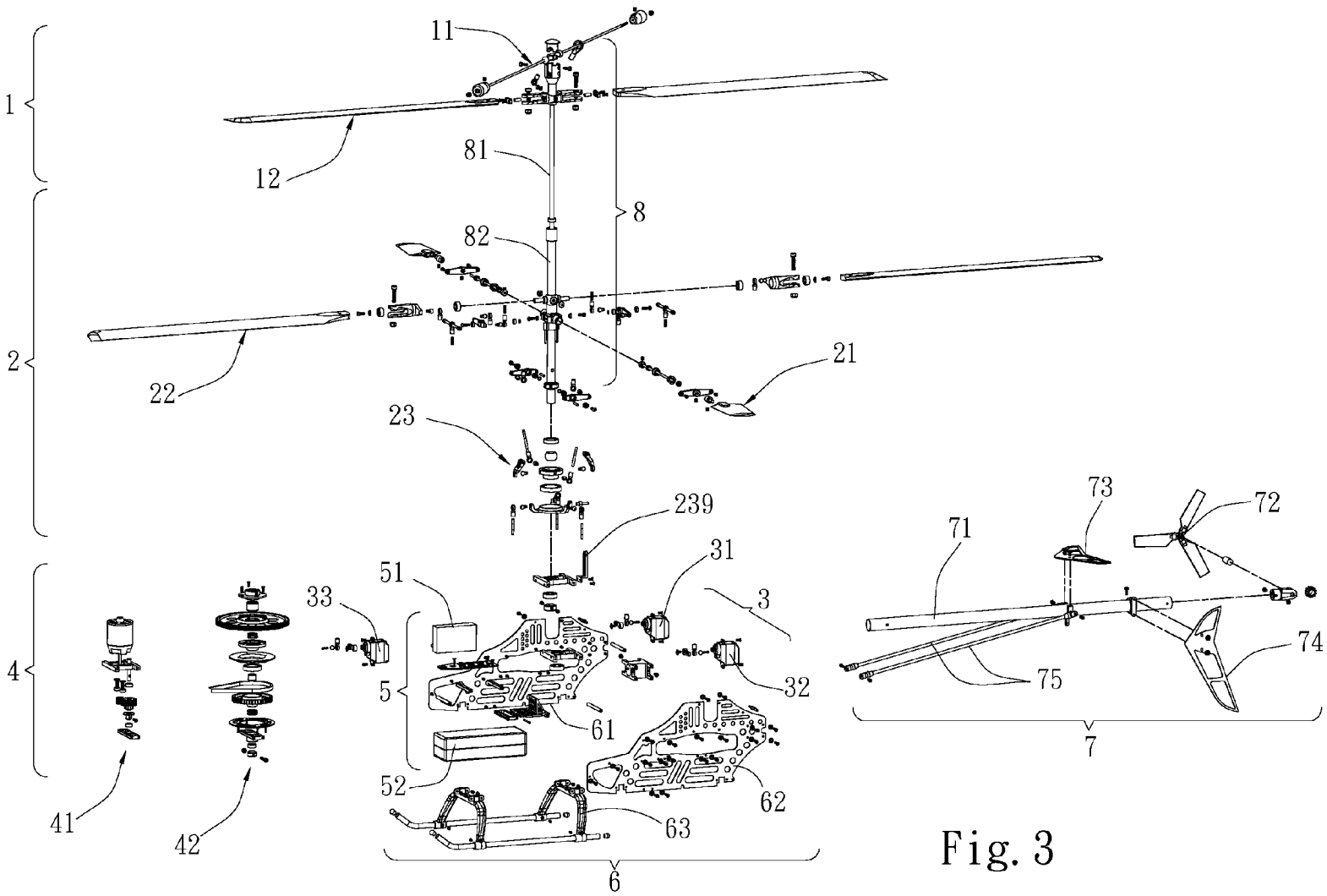
FIG. 3 is an exploded view according to FIG. 1.
Figure 11:
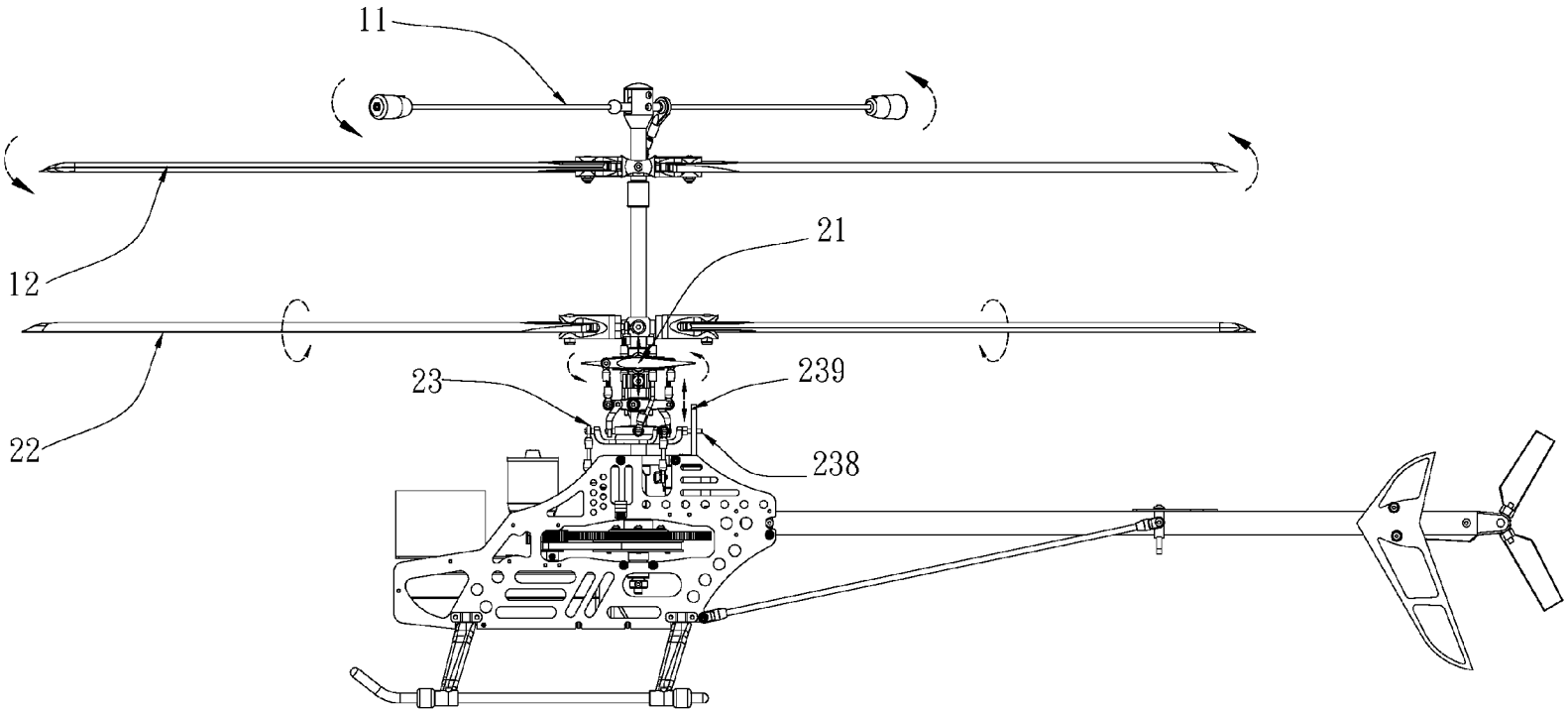
FIG. 11 is a side view according to FIG. 1.

The transmission mechanism includes three linkage bar mechanisms 24, 25 and 26 and a slant rotary disk. The slant rotary disk is coupled with the outer shaft 82 of the main shaft 8 through a ball coupler 234 in a turnable manner, and includes an upper disk 232 and a lower disk 231 that are rotated about the ball coupler 234 through a spring 233 wedged in the center of the slant rotary disk. The lower disk 231 has three ball coupler nodes 235 and a direction fixing bar 238 at one side extended outwards. The direction fixing bar 238 is fixed in a direction fixing trough 239 formed on the fuselage and slidable longitudinally in the trough as shown in FIGS. 3 and 11. The ball coupler nodes 235 of the lower disk 231 are connected to the rudder set 33 through the third linkage bar mechanism 26 (including three linkage bars). The upper disk 232 has four ball coupler nodes 236 at one side extended outwards that are perpendicular to each other. Two opposing ball coupler nodes 236 thereof form one set, and are connected to the eccentric control end 224 of the lower rotor 22 through the first linkage bar mechanism 25, and connected to the frame element 215 of the outer frame in the middle of the direction control bar 211 through the second linkage bar mechanism 24.

Figure 9:
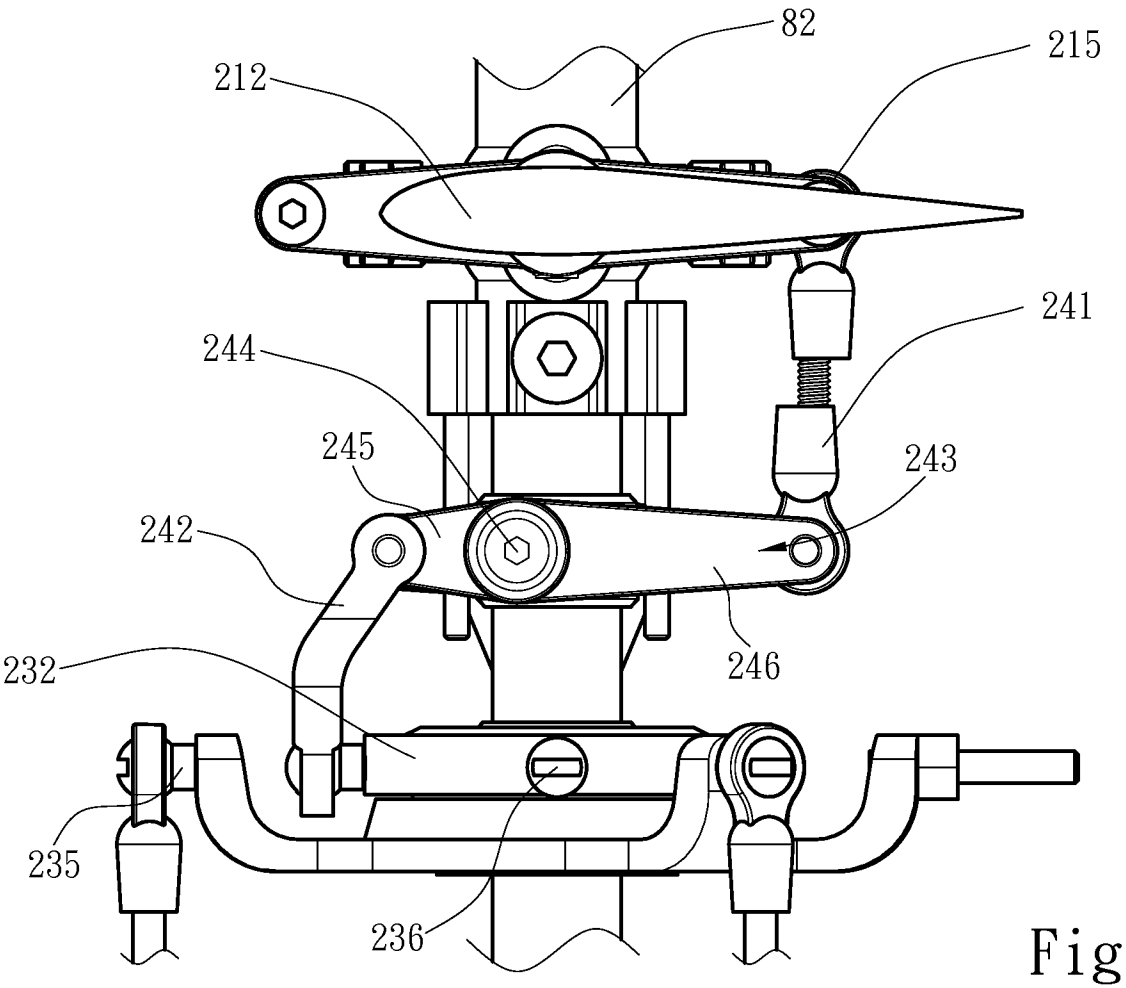
FIG. 9 is a schematic view of a structure driving the Bell-Hiller control structure.

The second linkage bar mechanism 24 bridges the upper disk 232 and the frame element 215, and includes a lower linkage bar 242 connecting to the upper disk 232, an upper linkage bar 241 connecting to the frame element 215 and a first lever mechanism 243 which has a short arm 245 connecting to the lower linkage bar 242 and a long arm 246 connecting to the upper linkage bar 241. The first lever mechanism 243 has a first fulcrum 244 located on the outer shaft 82 as shown in FIG. 9 which illustrates only one set of mechanism to facilitate viewing. When the upper disk 232 is tilted, the lower linkage bar 242 is moved downwards to amplify and transmit the tilted movement of the upper disk 232 through the first lever mechanism 243 to the upper linkage bar 241, then the upper linkage bar 241 drives the outer frame to rotate, thereby to change the thread pitch of the blade 212. To improve maneuverability, the present invention utilizes the first lever mechanism 243 to amplify the movement of the slant rotary disk 23, so that the slant rotary disk 23 has higher sensitivity.

Figure 10:
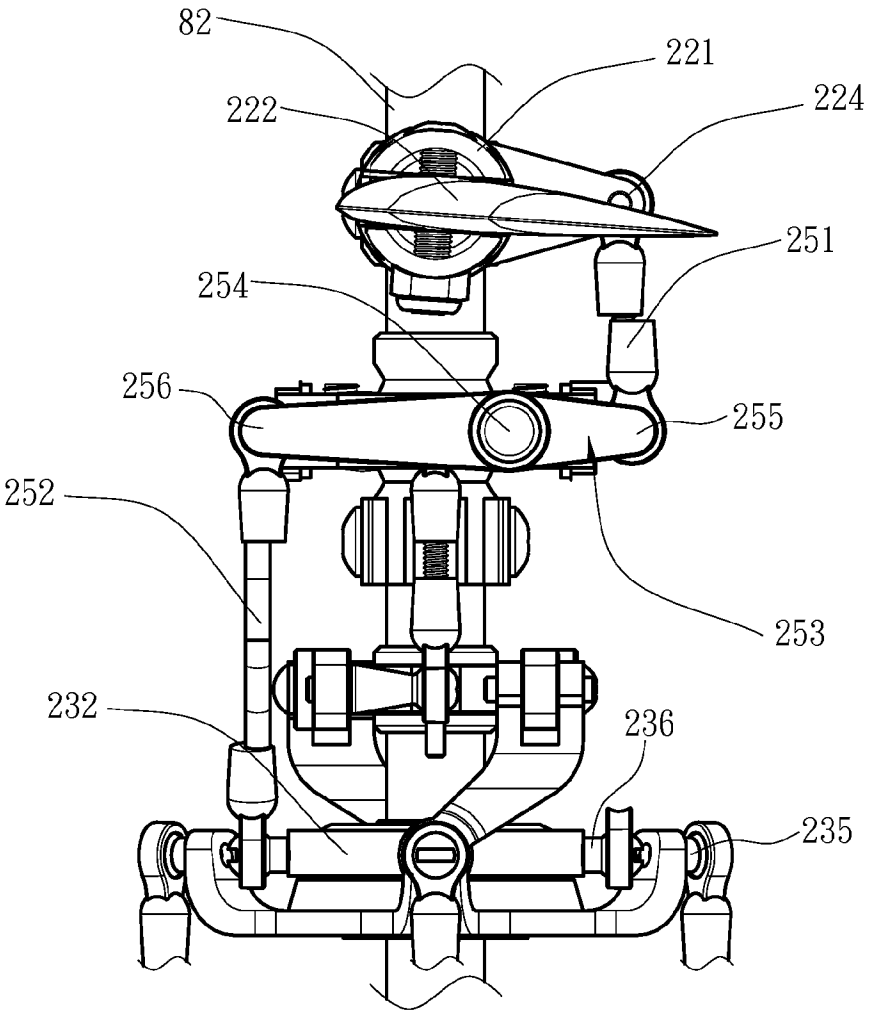
FIG. 10 is a schematic view of a control structure of the lower rotor.

The first linkage bar mechanism 25 bridges the upper disk 232 and the eccentric control end 224 of the lower rotor 22, and includes a lower linkage bar 252 connecting to the upper disk, an upper linkage bar 251 connecting to the eccentric control end 224 and a second lever mechanism 253 which includes a long arm 256 connecting to the lower linkage bar 252 and a short arm 255 connecting to the upper linkage bar 251. The second lever mechanism 253 has a second fulcrum 254 located on the outer shaft 82 as shown in FIG. 10 which illustrates only one set of mechanism to facilitate viewing. When the upper disk 232 is tilted, the lower linkage bar 252 is moved downwards to shrink and transmit the tilted movement of the upper disk 232 through the second lever mechanism 253 to the upper linkage bar 251, the upper bar 251 drives the eccentric control end 224 to change the thread pitch of the lower rotor 22. During flying, alteration of the thread pitch of the lower rotor 22 is smaller than that of the blade 212. In order to control alterations of two thread pitches through the same slant rotary disk 23, the present invention shrinks the movement of the slant rotary disk 23 through the second lever mechanism 253, thus the structure is simplified and also more stable. By means of the foregoing structure, the present invention provides great maneuverability same as that of WO 02/064425 A2 with a simpler structure but greater stability.

In order to make the first lever mechanism 243 to be rotated synchronously with the main shaft, the present invention provides two detent struts 28 located between the outer shaft 82 and the second linkage bar mechanism 24 which bridges the slant rotary disk 23 and the outer frame and extended in the direction along the main shaft 8.

Referring to FIG. 11, the Bell self-balance mechanism 11 generates a centrifugal force through rotation to drive the upper rotor 12 to move synchronously in the tilted manner, and automatically correct unbalanced conditions of the helicopter during flying to maintain stability of the fuselage. Through the up and down moving of the slant rotary disk 23, alteration of the thread pitch of the blades of the lower rotor 22 and Bell-Hiller control structure 21 can be controlled to control movements of ascending, descending and spiraling of the helicopter.

Figure 12:
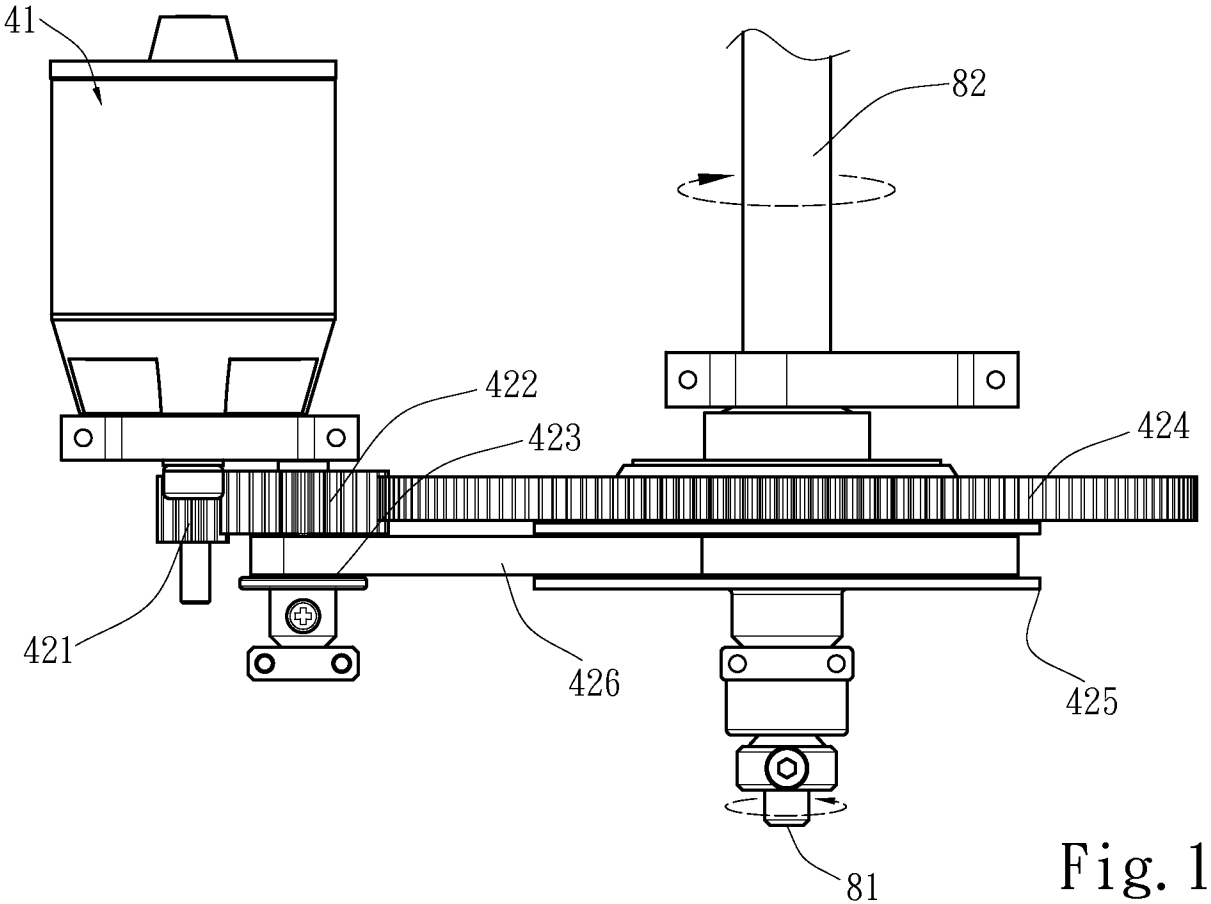
FIG. 12 is a schematic view of the main shaft power system.

The inner and outer shafts 81 and 82 of the main shaft 8 are rotated in opposite directions by driving of the electric apparatus 41 through the speed changing mechanism 42 as shown in FIG. 12. The speed changing apparatus 42 comprises a main active gear 421 fixed on the spindle of the electric apparatus, a belt gear including a pinion 422 and a small pulley 423 that rotate coaxially, a large gear 424 fixed on the outer shaft 82, a large pulley 425 and a synchronous belt 426 fixed on the inner shaft 81. The large gear 424 is engaged with the pinion 422, the synchronous belt 426 is coupled on the large pulley 425 and the small pulley 423, and the main active gear 421 drives the large gear 424 and the large pulley 425 to rotate in opposite directions through the belt gear.

What is claimed is:

1. A dual-rotor model helicopter control system, comprising:

a power control mechanism;

a transmission mechanism;

a control mechanism; and a rotor mechanism controlled by the power control mechanism through the transmission mechanism and the control mechanism;

wherein the rotor mechanism includes a main shaft, an upper rotor and a lower rotor that are installed coaxially on the main shaft in an up and down manner and controlled respectively by an inner shaft and an outer shaft for rotation;

wherein the control mechanism includes a Bell self-balance mechanism to control the upper rotor and a Bell-Hiller control structure to control the lower rotor; and wherein the transmission mechanism includes a slant rotary disk and a first linkage bar mechanism which bridges the slant rotary disk and the lower rotor and includes a first lower linkage bar connecting to the slant rotary disk, a first upper linkage bar connecting to the lower rotor and a first lever mechanism pivoting on the main shaft and including a long arm connecting to the first lower linkage bar and a short arm connecting to the first upper linkage bar, such that the slant rotary disk controls the lower rotor through the first linkage bar mechanism; and wherein the inner shaft and the outer shaft of the main shaft are rotated by power provided from an electric apparatus through a speed changing mechanism to rotate in opposite directions;

wherein the speed changing mechanism includes a main active gear fixed on the spindle of the electric apparatus, a belt gear including a pinion and a small pulley that rotate coaxially, a large gear fixed on the outer shaft, a large pulley and a synchronous belt fixed on the inner shaft; the large gear being engaged with the pinion, the synchronous belt being coupled on the large pulley and the small pulley, the main active gear driving the large gear and the large pulley to rotate in apposite directions through the belt gear.

2. The dual-rotor model helicopter control system of claim 1, wherein the Bell self-balance mechanism includes a balance bar and balance weights located at two ends of the balance bar, the upper rotor and the Bell self-balance mechanism being installed on an upper portion of the inner shaft of the main shaft respectively through two spindles perpendicular to the main shaft at two parallel planes and connected through the balance bar, the upper rotor and the Bell self-balance mechanism revolve respectively about axes thereof in a tilted manner.

3. The dual-rotor model helicopter control system of claim 1, wherein the Bell-Hiller control structure includes a direction control bar and blades installed on two ends of the direction control bar, the lower rotor and the Bell-Hiller control structure being installed on a lower portion of the outer shaft of the main shaft through axles that are perpendicular to the main shaft, the lower rotor and the Bell-Hiller control structure being perpendicular to each other and coupled with the power control mechanism through the transmission mechanism, the axles of the lower rotor and the Bell-Hiller control structure being parallel with and perpendicular to each other, the axle of the lower rotor coinciding with the axis of the lower rotor, the lower rotor revolving about the axis thereof, the Bell-Hiller control structure revolving about the axle thereof in a tilted manner.

4. The dual-rotor model helicopter control system of claim 3, wherein the power control mechanism includes three rudder sets, the transmission mechanism further including a second linkage bar mechanism and a third linkage bar mechanism, the slant rotary disk being coupled with the outer shaft of the main shaft in a turnable manner through a ball coupler and including an upper disk and a lower disk which has three ball coupler nodes and a direction fixing bar at one side extended outwards, the direction fixing bar being fixed in a direction fixing trough formed on a fuselage and slidable longitudinally in the trough, the ball coupler nodes of the lower disk being connected to one rudder set through the third linkage bar mechanism, the upper disk including four ball coupler nodes at one side extended outwards that are perpendicular to each other, two opposite ball coupler nodes of the upper disk respectively being connected to the lower rotor through the first linkage bar mechanism, and another two opposite ball coupler nodes of the upper disk respectively connected to the direction control bar through the second linkage bar mechanism.

5. The dual-rotor model helicopter control system of claim 4, wherein the lower rotor includes two lower rotor clips and two lower blades, the lower rotor clips including a front end to clamp the lower blades and a distal end inserted into the axle of the lower rotor, and an eccentric control end located at one side thereof, the upper disk of the slant rotary disk being coupled with the eccentric control end through the first linkage bar mechanism to control revolving of the lower rotor about the axle thereof.

6. The dual-rotor model helicopter control system of claim 4, wherein the second linkage bar mechanism bridging the slant rotary disk and the direction control bar includes a second lower linkage bar connecting to the upper disk, an second upper linkage bar connecting to the direction control bar and a second lever mechanism which is pivoted on the main shaft and includes a short arm connecting to the second lower linkage bar and a long arm connecting to the second upper linkage bar.

7. The dual-rotor model helicopter control system of claim 6, wherein the direction control bar includes a middle portion coupled on the main shaft through a frame to be rotated, the frame including an inner frame and an outer frame, the inner frame rotating about the axle of the Bell-Hiller control structure in a vibration manner, the outer frame rotating about the axis of the direction control bar in a vibration manner, the direction control bar being fixedly on the outer frame, the slant rotary disk being coupled with two ends of the outer frame through the second linkage bar mechanism to control the angle of the blades at the distal end of the direction control bar.

8. The dual-rotor model helicopter control system of claim 7, wherein two detent struts are located between the main shaft and the second linkage bar mechanism bridging the slant rotary disk and the outer frame and extended in the direction along the main shaft.

* * * * *